US010765197B2

(12) United States Patent
Peterson

(10) Patent No.: US 10,765,197 B2
(45) Date of Patent: Sep. 8, 2020

(54) FOOT BROOM DEVICES AND METHODS

(71) Applicant: Ryan Curtis Peterson, Pine River, MN (US)

(72) Inventor: Ryan Curtis Peterson, Pine River, MN (US)

( * ) Notice: Subject to any disclaimer, the term of this patent is extended or adjusted under 35 U.S.C. 154(b) by 197 days.

(21) Appl. No.: 15/676,690

(22) Filed: Aug. 14, 2017

(65) Prior Publication Data

US 2018/0070715 A1 Mar. 15, 2018

Related U.S. Application Data

(60) Provisional application No. 62/395,022, filed on Sep. 15, 2016.

(51) Int. Cl.

| | |
|---|---|
| ***A46B 7/04*** | (2006.01) |
| ***A47L 13/10*** | (2006.01) |
| ***A46B 5/04*** | (2006.01) |
| ***A47L 13/50*** | (2006.01) |
| *A43C 19/00* | (2006.01) |
| *A43B 3/20* | (2006.01) |
| *A43B 3/16* | (2006.01) |

(52) U.S. Cl.

CPC ..... *A46B 5/04* (2013.01); *A46B 7/04* (2013.01); *A47L 13/50* (2013.01); *A43B 3/16* (2013.01); *A43B 3/20* (2013.01); *A43C 19/00* (2013.01); *A46B 2200/302* (2013.01)

(58) Field of Classification Search

CPC ..... A46B 7/04; A47L 13/10; A47L 13/282; A47L 13/50

See application file for complete search history.

(56) References Cited

U.S. PATENT DOCUMENTS

| | | | | |
|---|---|---|---|---|
| 599,495 A * | 2/1898 | Durel et al. | A46B 5/02 | 15/143.1 |
| 2,784,436 A * | 3/1957 | Peterson | A47L 13/282 | 15/227 |
| 3,085,541 A * | 4/1963 | Leach | B63B 59/08 | 114/222 |
| 3,526,014 A * | 9/1970 | Edwards | A47L 13/282 | 15/227 |
| 6,092,313 A * | 7/2000 | Dunlap | A43B 3/00 | 36/132 |
| 6,393,648 B1 * | 5/2002 | Reynolds | A46B 17/02 | 15/160 |

(Continued)

FOREIGN PATENT DOCUMENTS

CN 201878843 6/2011

OTHER PUBLICATIONS

'dornob.com' [online]. "Shoe Sweeps: Floor-Cleaning Footwear Dusts & Disinfects," Jul. 12, 2012 [retrieved on Nov. 14, 2017]. Retrieved from the Internet: URL <https://dornob.com/shoe-sweeps-floor-cleaning-footwear-dusts-disinfects/>. 3 pages.

'bitrebels.com' [online]. "Pet Sweep: Let Your Dog or Cat Do the Floor Sweeping," Dec. 14, 2012 [retrieved on Nov. 14, 2017]. Retrieved from the Internet: URL http://www.bitrebels.com/business/jafx-ecn-forex-broker-review/. 10 pages.

(Continued)

*Primary Examiner* — Michael D Jennings

(74) *Attorney, Agent, or Firm* — Fish & Richardson P.C.

(57) ABSTRACT

Foot broom devices are releasably attachable to footwear such as a shoe or boot. In some examples, such a foot broom device enables a user to quickly, conveniently, and frequently sweep debris from an area to keep it clean.

10 Claims, 2 Drawing Sheets

(56) References Cited

U.S. PATENT DOCUMENTS

| | | | | |
|---|---|---|---|---|
| 7,313,842 | B1 * | 1/2008 | Preciado | A43B 3/00 15/105 |
| 7,814,605 | B1 * | 10/2010 | Tippel | A43B 1/009 15/114 |
| 8,458,847 | B2 * | 6/2013 | Herrmann | A43B 3/163 15/160 |
| D787,832 | S * | 5/2017 | Ferguson | D2/946 |
| 9,723,914 | B2 * | 8/2017 | Connelly | A46B 15/0055 |
| 2004/0040110 | A1 * | 3/2004 | Fletcher | A47L 13/282 15/227 |
| 2011/0138557 | A1 * | 6/2011 | Herrmann | A43B 3/163 15/160 |
| 2014/0338142 | A1 * | 11/2014 | Pierce | A63B 57/60 15/246 |

OTHER PUBLICATIONS

'weburbanist.com' [online]. Jul. 31, 2014 [retrieved on Jul. 20, 2017]. Retrieved from the Internet: URL <https://weburbanist.com/wp-content/uploads/2013/06/Chindogu-Sweep-Shoes.jpg>. 1 page.

'banggood.com' [online]. May 30, 2015 [retrieved on Jul. 20, 2017]. Retrieved from the Internet: URL <https://blog.banggood.com/wp-content/uploads/2015/02/SKU082681-9.jpg.>. 1 page.

'i.pinimg.com' [online]. Available online before Sep. 15, 2016 [retrieved on Jul. 20, 2017]. Retrieved from the Internet: URL https://i.pinimg.com/564x/d1/79/1a/d1791abdd44f67eb58e073a679eb0520.jpg. 1 page.

'g01.a.alicdn.com' [online]. Available online before Sep. 15, 2016 [retrieved on Jul. 20, 2017]. Retrieved from the Internet: URL https://i.pinimg.com/564x/d1/79/1a/d1791abdd44f67eb58e073a679eb0520.jpg. 1 page.

* cited by examiner

FOOT BROOM DEVICES AND METHODS

TECHNICAL FIELD

This application generally relates to foot brooms, such as brooms that are releasably attachable to a shoe or boot.

BACKGROUND

In some cases, small areas need to be swept clean frequently and quickly. Obtaining and using a handheld broom to perform such sweeping may take too much time, and so in some cases sweeping is postponed or avoided all together.

Small handheld brooms, such as whisk brooms, may require bending over to use, which can be difficult or burdensome for users with a lower back strains or other impairments, especially if the task is repetitive.

SUMMARY

This document describes broom devices that are attachable to footwear, such as a shoe or boot, or otherwise wearable on a user's foot. Such foot broom devices can, in some circumstances, provide quick and convenient option for sweeping debris from a floor, including regions of a floor area that are narrow or confined or regions or a floor that might otherwise require the user to bend or kneel.

In one aspect, this disclosure is directed to a foot broom device. Such a foot broom device can include a bracket defining a space configured to receive a portion of a user's footwear; a strap member extending from the bracket and configured to wrap around the footwear to releasably attach the bracket to the footwear; and a broom attached to the bracket and comprising a plurality of bristles.

Such a foot broom device may optionally include one or more of the following features. The broom may be fixedly attached to the bracket. The broom may be adjustably attached to the bracket. The space may be configured to receive a heel portion of the user's footwear. The space may be configured to receive an outsole portion of the user's footwear. The space may be configured to receive a toe portion of the user's footwear. The strap member may include one or more elastic portions. The strap member may be a first strap member and the foot broom may also include a second strap member extending from the bracket and configured to wrap around the footwear to releasably attach the bracket to the footwear.

In another aspect, this disclosure is directed to a foot broom device that includes means for moving debris; and means for attaching the means for moving debris to footwear.

Such a foot broom device may optionally include one or more of the following features. The means for attaching the means for moving debris to footwear may include a bracket defining a space configured to receive a portion of the footwear. The space may be configured to receive a heel portion of the footwear. The means for attaching the means for moving debris to footwear may include a bracket configured to extend within the footwear. The means for moving debris may include a broom with a plurality of bristles.

In another aspect, this disclosure is directed to a method of sweeping an area. The method includes: connecting a foot broom device to footwear worn by a user or to be worn by the user, and moving, by the user while wearing the footwear with the foot broom device attached to the footwear, the footwear such that a plurality of bristles sweep a selected area. The foot broom device includes: a bracket defining a footwear-receiving space, a strap member extending from the bracket, and a broom attached to the bracket and comprising a plurality of bristles. The connecting step of the method includes: positioning a portion of the footwear in the footwear-receiving space; and wrapping the strap member around the footwear to releasably attach the bracket to the footwear.

Such a method may optionally include one or more of the following features. The portion of the footwear may be a toe portion and the broom may be positioned in front of the user's foot while wearing the footwear with the foot broom attached to the footwear. The portion of the footwear may be a heel portion and the broom may be positioned behind the user's foot while wearing the footwear with the foot broom attached to the footwear. The portion of the footwear may be an outsole portion and the broom may be positioned lateral of the user's foot while wearing the footwear with the foot broom attached to the footwear. The user may be an umpire and the area is a home plate of a baseball diamond. The method may also include adjusting the orientation of the broom relative to the bracket. The strap member may be a first strap member and the foot broom may also include a second strap member extending from the bracket. The method may also include wrapping the second strap member around the footwear to releasably attach the bracket to the footwear.

Some or all of the embodiments described herein may provide one or more of the following advantages. The foot brooms provided herein are well-suited to facilitate quick sweeping of small areas. For example, in one implementation, a home plate of a baseball diamond can be quickly and conveniently swept of dirt by an umpire. In other example implementations, factory workers can sweep small areas that are prone to frequently becoming dirty (such as areas where powders are dispensed, for example). Moreover, janitors and other types of maintenance workers may find it convenient and advantageous to wear and use the foot brooms described herein. Since the foot brooms described herein can be worn attached to a user's footwear, there is no need to spend time searching for a broom, or to carry a broom. Hence, time can be saved, and sweeping may tend to be performed more frequently. Also, the foot brooms described herein can be used without bending over. Therefore, some injury risks to users (back injuries, for example) may be mitigated.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and indications in the various drawings indicate like elements.

DETAILED DESCRIPTION OF ILLUSTRATIVE EMBODIMENTS

Figure 1:
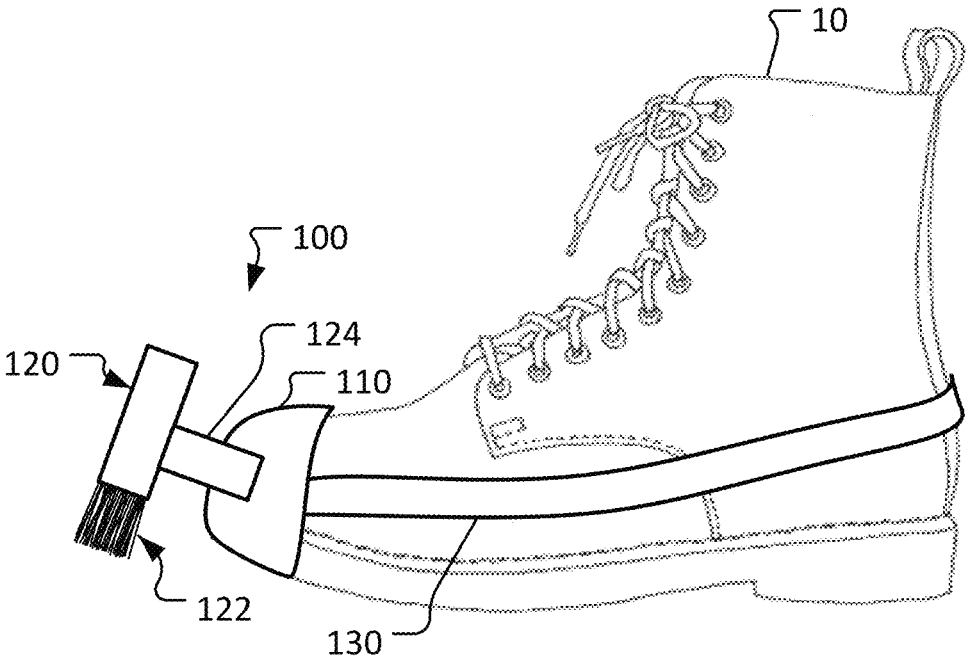
FIG. 1 shows a first example implementation of a foot broom in accordance with some embodiments described herein.

Referring to FIG. 1, an example foot broom 100 can be attached to a user's footwear, such as a boot 10 in this example implementation. The foot broom 100 is releasably attachable to the boot 10. Hence, a user can don and wear the foot broom 100 on the boot 10 at times, and thereafter remove the foot broom 100 from the boot 10 when the presence of the foot broom 100 is no longer desired.

The foot broom 100 includes a bracket 110, a broom 120, and a strap member 130. The strap member 130 extends from the bracket 110 and is configured to wrap around the boot 10 to releasably attach the bracket 110 (and the foot broom 100 as a whole) to the boot 10. The foot broom 100 may be donned onto the boot 10 while the user is wearing the boot 10, or prior to wearing the boot 10. The broom 120 is attached to the bracket 110 and comprises a plurality of bristles 122.

The bracket 110 defines a space configured to receive a portion of the boot 10. In the depicted example, the portion of the boot 10 that the space is configured to receive is a toe portion of the boot 10. Hence, while the boot 10 with the attached foot broom 100 is worn by a user, the broom 120 is positioned in front of the user's foot.

The bracket 110 may be constructed of any suitable material such as, but not limited to, plastic, metal, rubber, leather, fabric, and the like, and combinations thereof. In some implementations, the bracket 110 includes a rubberized non-slip portion on the bottom of the bracket 110. The bracket 110 may be constructed using any suitable technique such as, but not limited to, molding, machining, stamping, sewing, and the like, and combinations thereof.

In some implementations, the bracket 110 is size-adjustable to fit on footwear of various sizes. In particular implementations, the bracket 110 is a fixed size. Various sizes of such a fixed-sized bracket 110 can be made available.

The strap member 130 extends from the bracket and is configured to wrap around the boot 10 to attach the bracket 110 (and the foot broom 100 as a whole) to the boot 10. In some implementations, the strap member 130 is a single strap that is attached to the bracket 110 at two points. Such a strap member 130 may be elastic as a whole, or include one or more elastic portions. In some implementations, the strap member 130 includes two portions that are coupled together around the boot 10. Such a two-portioned strap member 130 may include elastic portions and/or one or more interfastening elements such as, but not limited to, VELCRO®, snaps, ties, buckles, clamps, and the like, and combinations thereof.

The strap member 130 may be constructed of any suitable material such as, but not limited to, natural rubber, synthetic rubber, plastic, leather, fabric, and the like, and combinations thereof. While the depicted embodiment includes a single strap member 130, in some implementations two or more strap members 130 are included. In such a case, the two or more strap members 130 can have differing orientations so as to provide enhanced securement of the foot broom 100 to the boot 10.

The broom 120 is attached to the bracket 110 and comprises a plurality of bristles 122. In the depicted embodiment, the broom 120 is attached to the bracket 110 by a mount 124. In some implementations, the mount 124 is adjustable such that the relative orientation between the broom 120 and the bracket 110 is selectively adjustable by a user. In some implementations, the mount 124 non-adjustable such that the relative orientation between the broom 120 and the bracket 110 is fixed.

The bristles 122 may be constructed of any suitable material such as, but not limited to, plastic, natural materials, metal fibers, composite materials, and the like, and combinations thereof. In some implementations, the extent to which the bristles 122 extend is selectively adjustable. In some implementations, the bristles 122 extend by a fixed (non-adjustable) amount. In particular implementations, the bristles 122 are replaceable such that new bristles 122 can be installed in the broom 120 when previous bristles 122 become worn or damaged.

Figure 2:
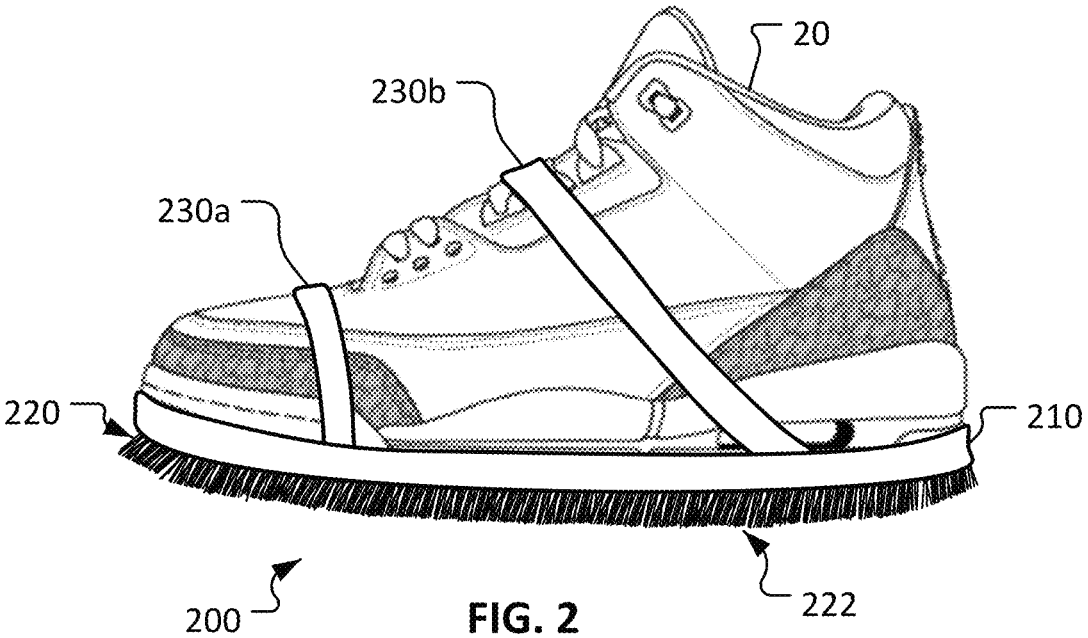
FIG. 2 shows another example implementation of a foot broom in accordance with some embodiments described herein.

Referring to FIG. 2, another example foot broom 200 can be attached to a user's footwear, such as a shoe 20 in this example implementation. The foot broom 200 is releasably attachable to the shoe 20. Hence, a user can don and wear the foot broom 200 on the shoe 20 at times, and thereafter remove the foot broom 200 from the shoe 20 when the presence of the foot broom 200 is no longer desired.

The foot broom 200 includes a bracket 210, a broom 220, a first strap member 230*a*, and a second strap member 230*b*. The strap members 230*a-b* extend from the bracket 210 and are configured to wrap around the shoe 20 to releasably attach the bracket 210 (and the foot broom 200 as a whole) to the shoe 20. The foot broom 200 may be donned onto the shoe 20 while the user is wearing the shoe 20, or prior to wearing the shoe 20. The broom 220 is attached to the bracket 210 and comprises a plurality of bristles 222.

The bracket 210 defines a space configured to receive a portion of the shoe 20. In the depicted example, the portion of the shoe 20 that the space is configured to receive is an outsole portion of the shoe 20. Hence, while the shoe 20 with the attached foot broom 200 is worn by a user, the broom 220 is positioned in lateral of the user's foot.

In some implementations, the bristles 222 extend around an entire periphery of the outsole of the shoe 20. In some implementations, the bristles 222 extend around a less-than-entire portion of the periphery of the outsole of the shoe 20. In some implementations, the bristles 222 comprise two or more distinct portions of bristles 220 that are spaced apart from each other around the periphery of the outsole of the shoe 20.

In some implementations, the bracket 210 is size-adjustable to fit on footwear of various sizes. In particular implementations, the bracket 210 is a fixed size. Various sizes of such a fixed-sized bracket 210 can be made available.

The features, materials, and construction techniques of the bracket 210, the broom 220, the bristles 222, and the strap members 230*a-b* can include any of the features, materials, and construction techniques of analogous elements described above in the context of the foot broom 100.

Figure 3:
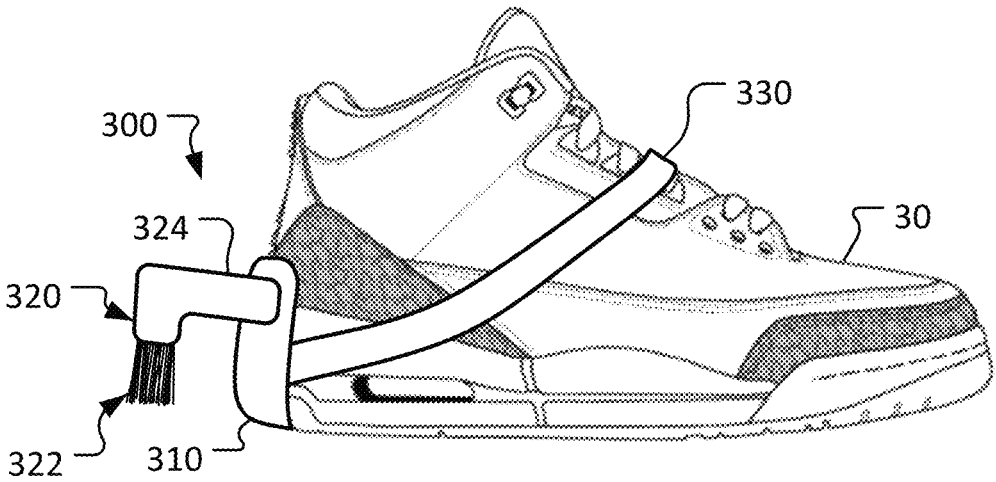
FIG. 3 shows another example implementation of a foot broom in accordance with some embodiments described herein.

Referring to FIG. 3, another example foot broom 300 can be attached to a user's footwear, such as a shoe 30 in this example implementation. The foot broom 300 is releasably attachable to the shoe 30. Hence, a user can don and wear the foot broom 300 on the shoe 30 at times, and thereafter remove the foot broom 300 from the shoe 30 when the presence of the foot broom 300 is no longer desired.

The foot broom 300 includes a bracket 310, a broom 320, and a strap member 330. The strap member 330 extends from the bracket 310 and is configured to wrap around the shoe 30 to releasably attach the bracket 310 (and the foot broom 300 as a whole) to the shoe 30. The foot broom 300 may be donned onto the shoe 30 while the user is wearing the shoe 30, or prior to wearing the shoe 30. The broom 320 is attached to the bracket 310 and comprises a plurality of bristles 322.

The bracket 310 defines a space configured to receive a portion of the shoe 30. In the depicted example, the portion of the shoe 30 that the space is configured to receive is heel portion of the shoe 30. Hence, while the shoe 30 with the attached foot broom 300 is worn by a user, the broom 320 is positioned behind the user's foot.

In the depicted embodiment, the broom 320 is attached to the bracket 310 by a mount 324. In some implementations, the mount 324 is adjustable such that the relative orientation between the broom 320 and the bracket 310 is selectively adjustable by a user. In some implementations, the mount 324 non-adjustable such that the relative orientation between the broom 320 and the bracket 310 is fixed.

The features, materials, and construction techniques of the bracket 310, the broom 320, the bristles 322, the strap members 330 can include any of the features, materials, and construction techniques of analogous elements described above in the context of the foot broom 100.

Figure 4:
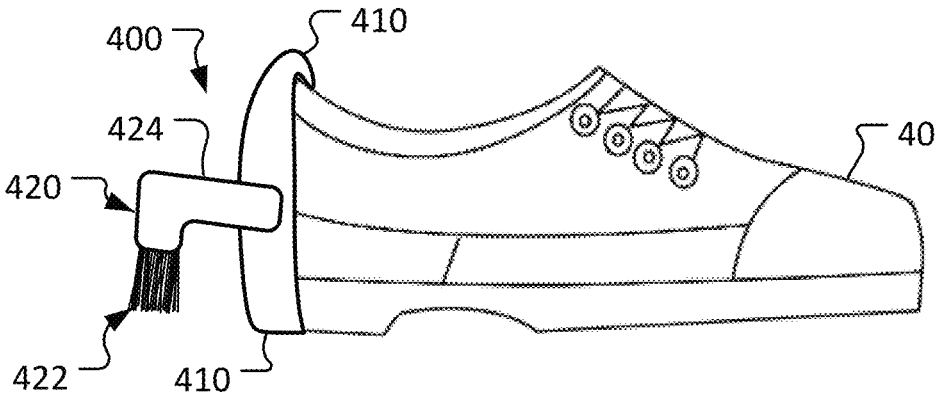
FIG. 4 shows another example implementation of a foot broom in accordance with some embodiments described herein.

Referring to FIG. 4, another example foot broom 400 can be attached to a user's footwear, such as a shoe 40 in this example implementation. The foot broom 400 is releasably attachable to the shoe 40. Hence, a user can don and wear the foot broom 400 on the shoe 40 at times, and thereafter remove the foot broom 400 from the shoe 40 when the presence of the foot broom 400 is no longer desired.

The foot broom 400 includes a bracket 410 and a broom 420. The bracket 410 includes a portion that extends (e.g., like a shoe horn) within the shoe 40 to releasably attach the bracket 410 (and the foot broom 400 as a whole) to the shoe 40. Hence, in some implementations no strap is needed. The foot broom 400 may be donned onto the shoe 40 while the user is wearing the shoe 40, or prior to wearing the shoe 40. The broom 420 is attached to the bracket 410 and comprises a plurality of bristles 422.

The bracket 410 defines a space configured to receive a portion of the shoe 40. In the depicted example, the portion of the shoe 40 that the space is configured to receive is heel portion of the shoe 40. Hence, while the shoe 40 with the attached foot broom 400 is worn by a user, the broom 420 is positioned behind the user's foot.

In the depicted embodiment, the broom 420 is attached to the bracket 410 by a mount 424. In some implementations, the mount 424 is adjustable such that the relative orientation between the broom 420 and the bracket 410 is selectively adjustable by a user. In some implementations, the mount 424 non-adjustable such that the relative orientation between the broom 420 and the bracket 410 is fixed.

The features, materials, and construction techniques of the bracket 410, the broom 420, and the bristles 422 can include any of the features, materials, and construction techniques of analogous elements described above in the context of the foot broom 100.

While this specification contains many specific implementation details, these should not be construed as limitations on the scope of the claims, but rather as descriptions of features specific to particular implementations of particular embodiments. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations of the subject matter have been described. Other implementations are within the scope of the following claims.

What is claimed is:

1. A foot broom device, comprising:

a bracket defining a space configured to receive a heel portion of a user's footwear, the bracket including a shoe horned portion configured to extend into an interior of the user's footwear while the foot broom device is worn on the user's footwear such that the heel portion of the user's footwear is within the space; and a broom attached to the bracket and comprising a plurality of bristles, wherein the foot broom device is configured to position the broom behind the heel portion of the user's footwear while the foot broom device is worn on the user's footwear.

2. The foot broom device of claim 1, wherein the broom is fixedly attached to the bracket.

3. The foot broom device of claim 1, wherein the broom is adjustably attached to the bracket.

4. The foot broom device of claim 1, wherein the bracket is also configured to extend along an outside of the user's footwear while the foot broom device is worn on the user's footwear.

5. The foot broom device of claim 1, wherein the bracket is configured to be clipped onto the heel portion of the user's footwear.

6. The foot broom device of claim 1, further comprising a mount extending between the bracket and the broom.

7. The foot broom device of claim 6, wherein the mount is adjustably attached to the bracket.

8. The foot broom device of claim 1, wherein an extension length of the plurality of bristles is selectively adjustable.

9. The foot broom device of claim 1, wherein plurality of bristles are removable and replaceable.

10. The foot broom device of claim 1, wherein the bracket is size-adjustable such that the foot broom device can be adjusted to be worn on various sizes of the user's footwear.

* * * * *